US006123989A

United States Patent [19]

Schürmann et al.

[11] Patent Number: 6,123,989

[45] Date of Patent: Sep. 26, 2000

[54] SPINNING ROTOR FOR AN OPEN-END SPINNING MACHINE AND METHOD FOR COATING THE SAME

[75] Inventors: Gottfried Schürmann, Schinveld; Bert Schlömer, Heinsberg; Harald Schneider, Geilenkirchen, all of Germany

[73] Assignee: W. Schlafhorst AG & Co., Germany

[21] Appl. No.: 09/362,622

[22] Filed: Jul. 28, 1999

Related U.S. Application Data

[62] Division of application No. 09/050,794, Mar. 30, 1998.

[30] Foreign Application Priority Data

Mar. 29, 1997 [DE] Germany ..... 197 13 359

[51] Int. Cl.[7] ..... B05D 7/22; B05D 1/18

[52] U.S. Cl. ..... 427/231; 427/241; 427/436; 427/345

[58] Field of Search ..... 427/241, 231, 427/234, 436, 345; 57/414, 416, 417

[56] References Cited

U.S. PATENT DOCUMENTS

| | | | |
|---|---|---|---|
| 4,358,923 | 11/1982 | Feldstein . | |
| 4,547,407 | 10/1985 | Spencer, Jr. . | |
| 4,662,170 | 5/1987 | Raasch | 57/416 |
| 4,866,927 | 9/1989 | Fetzer et al. | 57/414 |
| 4,928,477 | 5/1990 | Kalitzki et al. | 57/416 |
| 6,047,538 | 4/2000 | Wassenhoven | 57/413 |

FOREIGN PATENT DOCUMENTS

| | | |
|---|---|---|
| 891 324 | 9/1953 | Germany . |
| 1 234 396 | 2/1967 | Germany . |
| 37 06 340 A1 | 9/1988 | Germany . |
| 43 05 626 A1 | 8/1994 | Germany . |
| 44 24 168 A1 | 1/1996 | Germany . |
| 38 10 775 C2 | 5/1996 | Germany . |
| 195 09 742 A1 | 9/1996 | Germany . |

*Primary Examiner*—Shrive Beck
*Assistant Examiner*—Jennifer Calcagni
*Attorney, Agent, or Firm*—Kennedy Covington Lobdell & Hickman LLP

[57] ABSTRACT

A spinning rotor (1) with a spinning cup (2) has an interior surface coated with a nickel dispersion layer (6) of an essentially even layer thickness having a concentration of hard material grains (7) embedded therein which is clearly less at the surface of the fiber slide face (9) than in the rotor groove. The coating is produced by bathing the spinning cup in a nickel dispersion bath during the final stage of which the concentration of the hard material grains in the bath is reduced at least in the bathing area, while the spinning cup is moved in this bath and rotated around its longitudinal axis while maintaining the spinning cup in a spatial orientation relative to the bath wherein an imaginary plane passing through the rotor groove is at least approximately perpendicular to the surface of the nickel dispersion bath.

11 Claims, 3 Drawing Sheets

SPINNING ROTOR FOR AN OPEN-END SPINNING MACHINE AND METHOD FOR COATING THE SAME

CROSS REFERENCE TO RELATED APPLICATION

This is a division of copending U.S. patent application Ser. No. 09/050,794, filed Mar. 30, 1998, entitled "Spinning Rotor for an Open-End Spinning Machine and Method for Coating the Same."

FIELD OF THE INVENTION

The present invention relates generally to spinning rotors for open-end spinning machines and, more particularly, relates to a novel spinning rotor wherein at least the interior surface of the spinning cup, which consists of its bottom interior surface, fiber slide face and rotor groove, is coated with a nickel dispersion layer with grains of an embedded hard material, and wherein the number of the hard material grains at the surface of the coating is greater in the area of the rotor groove than at the surface of the coating on the other surfaces. The invention furthermore relates to a method for coating the spinning rotor.

BACKGROUND OF THE INVENTION

The rotational speeds (rpm) of spinning rotors of open-end spinning machines have been continuously increased in the past. Over the same time the rpm have been increased, the diameters of the spinning rotors have been reduced.

It has been noted that with the changing of the rotor geometry an optimal yarn formation can only be achieved if the surfaces which come into contact with the fibers fed into the rotor have a different frictional resistance in accordance with their involvement in the yarn-forming process.

Specifically, the fiber slide face on which the fibers are fed into the rotor should have a relatively slight roughness, so that the fibers are taken along by the rotor, but still can easily slide into the rotor groove under the centrifugal force of the rotor rotation. In contrast, the rotor groove should have a greater frictional resistance than the fiber slide face, so that the fibers are accelerated to the circumferential velocity by no later than the time the fibers reach the groove.

A spinning rotor is known from German Patent Publication DE 43 05 626 A1, whose fiber slide face and rotor groove have different degrees of roughness and therefore different frictional resistance. This known spinning rotor is initially provided with a nickel-diamond coating in a dispersion bath. In this case the nickel coating provides the appropriate corrosion protection, while the desired roughness and wear resistance is achieved by means of the diamond grains embedded in the nickel coating. In order to provide the different roughness of the fiber slide face and the rotor groove, the spinning rotor is subjected to a mechanical finishing process after coating, i.e. the fiber slide face is separately smoothed.

The processing method following the coating process is elaborate and involves additional process steps. For example, during the polishing process great care must be taken that the rotor groove is not also processed. Following the end of the polishing process it is furthermore necessary to carefully remove the polishing agent as well as the particles removed from the surface, for example by means of a rinsing process.

OBJECT AND SUMMARY OF THE INVENTION

Based on the above-mentioned prior art, it is an object of the instant invention to develop an improved method for coating a spinning rotor and, in turn, an improved spinning rotor. The spinning rotor is intended to have a high degree of roughness in the rotor groove and reduced roughness in the area of the fiber slide face following the coating process, without the need for elaborate finishing work.

In accordance with the present invention, this object is attained by means of a spinning rotor for an open-end spinning machine basically comprising a spinning cup having an interior spinning area defined by a circumferential fiber collection groove, a fiber slide face annularly adjacent one side of the groove and a bottom surface annularly adjacent an opposite side of the groove. The interior spinning area has a coating of an essentially uniform thickness comprising a nickel dispersion layer with grains of a hard material embedded therein. According to the present invention, the concentration of the hard material grains at the surface of the coating in the area of the groove is greater than at the surface of the coating in the area of the fiber slide face and the bottom surface, and the concentration of the hard material grains across the thickness of the coating outside of the groove decreases progressively in the direction toward the coating surface.

The spinning rotor in accordance with the invention has the advantage that the nickel dispersion layer essentially has the same thickness on all surfaces of the rotor cup. That is, the surface of the nickel dispersion layer has the structure created during coating, even on the surfaces where a reduced roughness is desired. Therefore, the coating layer does not have depressions, such as are unavoidably created when breaking off protruding hard material grains in the course of finishing.

The differential concentration of hard material grains in the surfaces of the nickel dispersion layer is achieved by means of a method in accordance with the invention for coating an open-end rotor spinning cup which has an interior spinning area defined by a circumferential fiber collection groove, a fiber slide face annularly adjacent one side of the groove and a bottom surface annularly adjacent an opposite side of the groove. The method basically comprises the steps of providing a nickel bath containing hard material grains finely dispersed therein in a predetermined concentration, and bathing the spinning cup in the nickel bath to apply a coating thereof to the spinning cup. As a final stage of such bathing step after a preselected thickness of the nickel dispersion layer has been attained, the concentration of the hard material grains in the nickel bath is reduced at least in the bathing area of the spinning cup, and the spinning cup is moved through the reduced-concentration nickel bath and rotated about its longitudinal axis while maintaining the spinning cup in a spatial orientation relative to the bath wherein an imaginary plane passing through the rotor groove is at least approximately perpendicular to the surface of the nickel bath.

As long as the concentration of the hard material grains is uniform in the nickel dispersion bath, the embedding of the hard material grains in the surface layer is also approximately uniform over the entire surface of the spinning cup. But as the concentration of the hard material grains in the nickel dispersion is reduced, the surfaces which are more easily accessible through the rotor cup opening, in particular the fiber slide face and the bottom surface, are first washed by the nickel dispersion bath with the reduced hard material grain concentration. This continuous bathing with a more pure nickel dispersion bath has the result that these more accessible surfaces are increasingly coated with a pure nickel dispersion layer, whereby the already embedded hard material grains are covered. The rotor walls bordering the rotor groove (i.e. the fiber slide face and the bottom surface) converge in a V-shape toward the rotor groove and thereby tend to capture a portion the nickel dispersion bath so as to retain therein a higher concentration of the hard material grains in this portion of the nickel dispersion, whereby the hard material grains still present in this portion of the nickel dispersion almost all settle in the rotor groove.

The preferred time period of the final stage of the coating process is a function of, among other things, the desired concentration of hard material grains in the surface of the coating of the rotor groove, the concentration of the hard material grains in the nickel dispersion bath, the size of the hard material grains, and their descent rate or rate of precipitation. While the size of the grains as well as the concentration of the hard material grains in the dispersion is known, the descent rate can easily be empirically determined by means of tests.

It is possible to control the uniformity of the concentration of the hard material grains in the nickel dispersion during the initial stage of the coating process in a simple manner by providing a means of continuously circulating the dispersion bath and, in turn, the concentration of the dispersion bath may be easily reduced during the final stage by stopping or reducing the output of the circulating means. The hard material grains then settle downward because of the gravitational force, so that the concentration of the hard material grains in the nickel dispersion continuously decreases, starting at the upper surface of the dispersion bath.

In a further advantageous aspect of the present method, the speed of movement of spinning rotors through the dispersion bath can be reduced during the final stage of the process. It is possible in this manner to prevent the hard material grains precipitating to the lower bath area from being churned up, as well as to facilitate the bathing process on the fiber slide face being effected through the rotor cup opening.

A roughness which is very resistant to wear is achieved on the respective surfaces in an advantageous manner by means of hard material grains made of diamonds. It has been shown to be advantageous in connection with placing diamond grains into a nickel dispersion layer if the rotor is made of heat-treated steel and if at least the surfaces to be coated are previously treated with boron. Boron treatment of such steel rotors is known from German Patent Publication DE 43 05 626 A1.

A particularly good adhesion of the nickel coating is achieved if a layer of α-iron is located between the surface layer treated with boron and the nickel coating applied to it. How this α-iron layer may be created is described in European Patent Publication EP 0 337 107 B1.

The invention will be explained in more detail hereinafter by means of an exemplary embodiment represented in the accompanying drawings.

DETAILED DESCRIPTION OF THE PREFERRED EMBODIMENT

Figure 1:
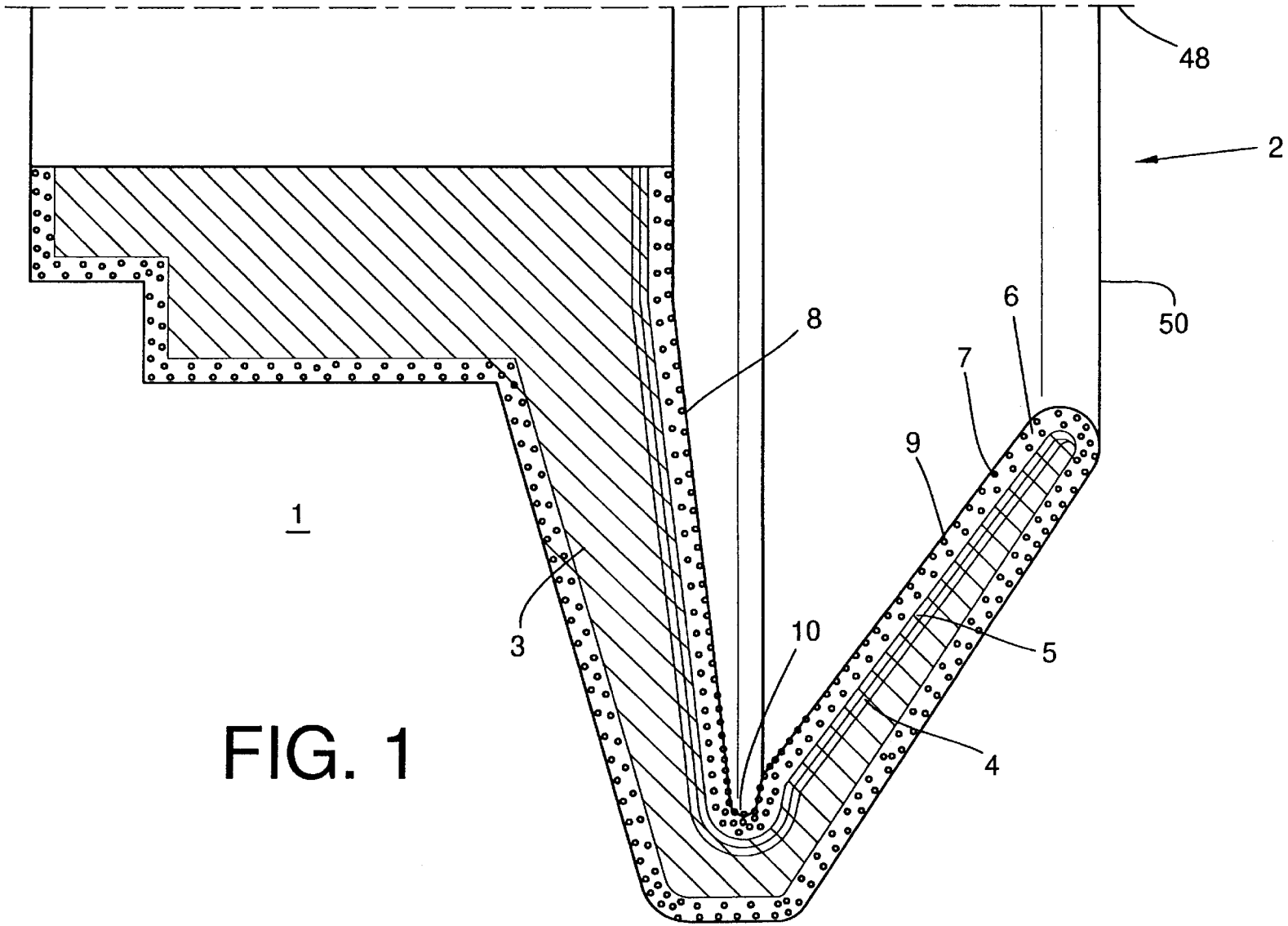
FIG. 1 is a cross-sectional view of the rotor cup of a spinning rotor in accordance with the present invention.

A rotor cup 2 of a spinning rotor in accordance with the present invention is represented in longitudinal section in FIG. 1. First, the surface of the body 3 of the rotor cup 2, preferably heat-treated steel, is treated with boron, as indicated by the layer 4. In addition, a layer 5 of α-iron was applied on the surface layer treated by boron by means of a special hardening process known from European Patent Publication EP 0 337 107 B1 before a coating of a nickel dispersion 6 is applied. Hard material grains are embedded in the nickel dispersion layer, in the present case diamond grains 7.

On its interior surface which comes into contact with the fibers during spinning operation of the rotor, the rotor cup 2 is configured to have a bottom surface 8, a fiber slide face 9 and a peripheral circumferential rotor groove 10. As can be seen from the cross section of the nickel dispersion coating 6, there is an uneven distribution of the diamond grains 7 in the nickel dispersion layer 6, in particular in the area of the outwardmost surface of the coating. That is, a relatively low concentration of hard material grains 7 can be found at the surfaces of the nickel dispersion layer 6 along the bottom surface 8 as well as along the fiber slide face 9, while the proportion of hard material grains 7 on the surface in the area of the rotor groove 10 is clearly greater.

Figure 3:
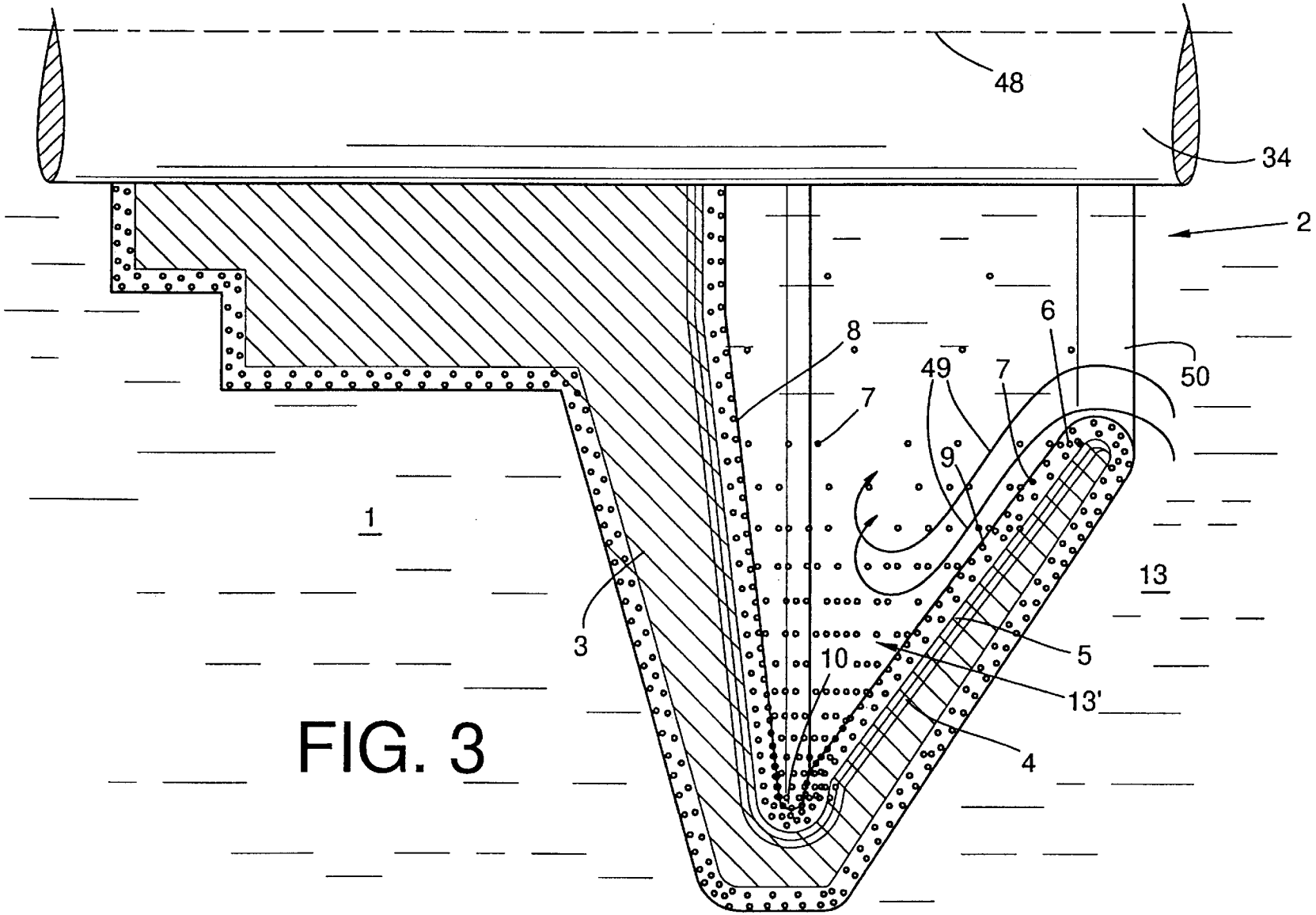
FIG. 3 depicts the coating process of the present invention during the deposition of hard material grains in the rotor groove of a spinning rotor cup.

In order to illustrate the distribution of the hard material grains on the surface of the individual surfaces of the rotor cup 2, the nickel dispersion coating 6 has been depicted in an enlarged scale in comparison with the remaining profiles of the spinning cup 2 in the exemplary embodiment in accordance with FIGS. 1 and 3. As indicated, the thickness of the nickel dispersion coating 6 is essentially the same on all surfaces of the spinning rotor 1, preferably approximately 25 μm.

In conventional coating methods, the proportion of the hard material grains 7 in the nickel dispersion coating 6 would be approximately the same 25% by volume at all surfaces and in all layer thicknesses. However, based on the coating process in accordance with the invention, the concentration of the hard material grains 7 differs both across the thickness of the coating layer and between the different surfaces 8, 9, 10. Clear differences between the individual surfaces 8, 9, 10 of the rotor cup 2 exist in particular at the surface of the nickel dispersion coating 6. For example, in the area of the bottom surface 8, the relatively high concentration of the hard material grains extends to a layer thickness of approximately 20 μm. At the fiber slide face there is a high concentration of the hard material grains 7 up to a layer thickness of approximately 22 μm, while the hard material grain concentration in the area of the rotor groove 10 extends up to the surface, or past the surface. That is, a portion of the embedded hard material grains are exposed in the rotor groove 10, while in the area of the bottom surface 8 and the fiber slide face 9 the grains are covered by the nickel dispersion layer 6 to a depth of approximately 2 to 3 μm.

Figure 2:
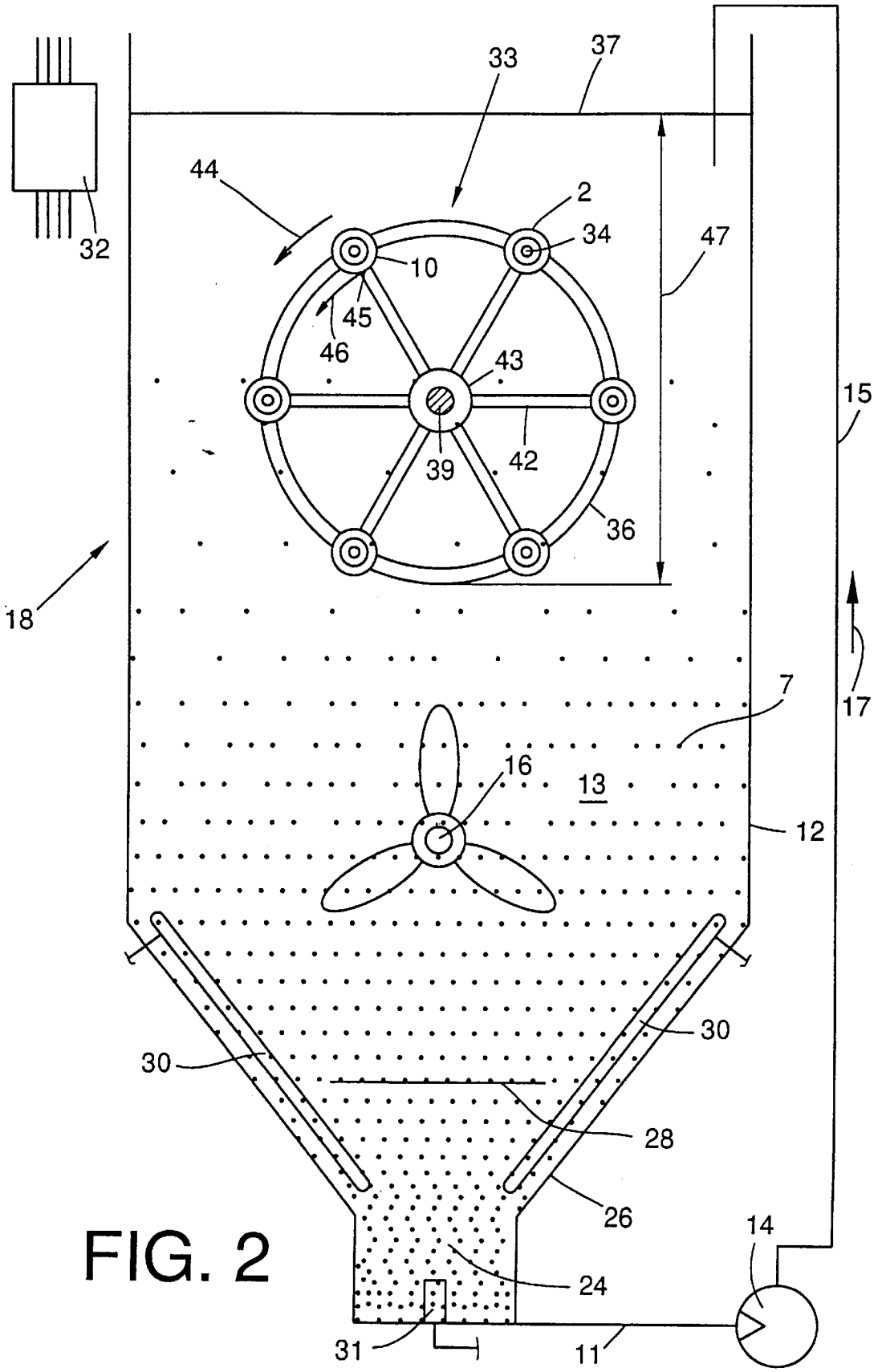
FIG. 2 schematically represents a nickel dispersion bath process for coating rotor cups to produce a spinning rotor cup in accordance with the present invention such as represented in FIG. 1.

FIG. 2 schematically represents a nickel dispersion coating apparatus 18 wherein a vat 12 contains a nickel dispersion bath 13 having approximately 8 to 15 grams of hard material grains 7 dispersed therein per liter of the bath. A mechanism 16 is disposed within the vat 12 for stirring the bath 13 and a pumping mechanism 14 is connected to the vat 12 by lines 11 and 15 for circulating the bath 13 through the vat 12. The cross-sectional dimension of these hard material grains 7, diamonds in the present case, lies between 2 and 4 μm. Preferably the nickel dispersion has a temperature of more than 80° C. The coating process lasts between 2 and 4 hours, wherein at least in the last stage of the coating process the concentration of the hard material grains 7 in the nickel dispersion bath 13, in particular in a dipping area 47 through which the spinning cups 2 are moved during the coating process, is continuously reduced by slowing or shutting down the stirring mechanism 16 and/or the pumping mechanism 14, for example.

The initial distribution of the hard material grains 7 in the nickel dispersion 13 at the start of the coating process should be substantially uniform and the dispersion is continuously stirred to maintain such uniformity in the grain distribution. The appropriate stirring mechanism 16 is schematically indicated in the center area of the vat 12.

The vat 12 is preferably funnel-shaped in the bottom area, so that the descending hard material grains 7 are always collected in the area of a bottom bowl 24. A deflector 28 is located above the bottom bowl 24 for evening the flow as well as to cause an effective swirling of the nickel dispersion 13 and therefore promote uniform distribution of the hard material grains 7. As indicated by a flow arrow 17, the nickel dispersion 13 is maintained in a continuous recirculating movement until a period of time at the end of the coating process.

Heating elements 30 provide an even heating of the nickel dispersion 13 to a temperature of preferably more than 80° C. The temperature is controlled by means of a thermostat 31, which is connected with a control device 32, which is simultaneously employed for controlling the drive means (not represented) of the stirring mechanism 16.

In order to obtain an even coating, the rotor cups 2 are moved through the nickel dispersion 13. To this end, the rotor cups 2 are arranged on a rotating device 33 which can be lifted out of the vat 12. As indicated, the rotating device 33 has rods 34 onto which the rotor cups 2 are mounted with the rods 34 extending through the openings in the rotor cups 2 by which each cup will later be mounted on a rotor shaft. In this case, a plurality of rotor cups 2 has been arranged respectively one behind the other on each rod 34. In turn, the rods 34 are fastened on the circumference of two wheel rims 36 located opposite each other. The wheel rims 36 are respectively seated in the wall of the vat 12 by means of a shaft 39, wherein at least one of the shafts 39 is driven by means of a motor (not represented). The rotational speed of this motor can be set in a defined manner by the control device 32.

During the turning of the rotating device 33, the rotor cups 2 maintain their spatial orientation in the nickel dispersion bath 18 to a large extent. Specifically, the disposition of the wheel 33 within the vat maintains the rotor cups in an orientation selected such that an imaginary plane passing through each rotor's groove 10 extends approximately perpendicularly in respect to the upper surface 37 of the nickel dispersion bath 13.

FIG. 2 depicts the performance of a final stage of the coating process in accordance with the present invention during which the recirculating arrangement of the stirring mechanism 16 and the pumping mechanism 14 is stopped. As a result, the uniformity of the distribution of the hard material grains 7 in the nickel dispersion bath 13 is no longer maintained and the grains 7 begin to precipitate from the bath. FIG. 2 depicts the precipitation of the grains as having progressed sufficiently, particularly within the upper dipping area 47 of the rotor cups 2, that the rotor cups 2 above the shaft 39 are already being moved through an almost pure nickel dispersion with virtually no remaining grains dispersed therein. As can be furthermore seen from the drawing, the concentration of the hard material grains 7 in the nickel dispersion 13 progressively increases in the funnel 26 in the direction toward the bottom bowl 24. Preferably, the number of revolutions of the rotating device 33 is reduced during this phase, so that swirling in the nickel dispersion 13 is not produced which would hamper the deposition of the hard material grains 7.

When a rotor cup 2 moves through the dipping area 47 during this stage of the coating process, with the concentration of the hard material grains in the nickel dispersion tending toward zero, a situation as represented in FIG. 3 results. FIG. 3 depicts a section through the rotor cup 2 of a spinning rotor 1, such as is shown in FIG. 1.

As shown in FIG. 3, a portion 13' of the nickel dispersion captured above the rotor groove 10 between the bottom surface 8 and the fiber slide face 9 of the rotor 1 still has the original concentration of the hard material grains 7 in the nickel dispersion 13. In contrast, the grains 7 in the nickel dispersion 13 surrounding the rotor 1 already have largely precipitated such that the concentration of hard material grains in this area tends toward zero. The concentration of the hard material grains 7 in the dispersion contained in the rotor 1 interiorly of the rotor opening 50 is still considerably higher and tends to increase in grain concentration in the direction toward the rotor groove 10. The distribution and concentration of the hard material grains 7 within this area occurs automatically because of gravity and, on the other hand, is also influenced by the movement of the spinning rotors in the nickel dispersion bath 18. As a result of this movement, the bath tends to flow in this area in a path indicated by the arrows 49 shown in FIG. 3 which bathes the surfaces adjoining the rotor opening 50. That is, the bottom surface 8 located opposite the rotor cup opening 50, as well as at least a portion of the fiber slide face 9 adjoining the rotor cup opening 50, are wetted by a nickel dispersion 13 which is almost free of hard material grains, so that a nickel dispersion layer 6 is deposited here which covers the hard material grains 7 previously deposited on these surfaces.

On the other hand, this bath flow 49 hardly touches the area of the rotor groove 10, whereby the hard material grains 7 still present within the portion 13' of the bath captured within this area are progressively deposited about the entire circumference of the rotor groove 10 until the concentration of the hard material grains 7 therein also approaches zero. To prevent the hard material grains thusly deposited in the area of the rotor groove 10 from becoming completely covered with a nickel dispersion layer 6, the coating process should be terminated no later than this time.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for coating a rotor cup for an open-end spinning rotor, the rotor cup having an interior spinning area defined by a circumferential fiber collection groove, a fiber slide face annularly adjacent one side of the groove and a bottom surface annularly adjacent an opposite side of the groove, the method comprising the steps of:

a) providing a nickel dispersion bath containing hard material grains dispersed therein in a predetermined first concentration, b) bathing the rotor cup in a bathing area of the nickel dispersion bath to apply a coating thereof to the rotor cup, and c) as a final stage of said bathing before removal of the rotor cup from the nickel dispersion bath:

i) reducing the concentration of the hard material grains in the nickel dispersion bath at least in the bathing area to a second concentration substantially less than said first concentration, and ii) simultaneously moving the rotor cup through the bathing area and spinning the rotor cup about its longitudinal axis while maintaining the spinning rotor cup in a spatial orientation within the bath wherein an imaginary plane passing through the rotor groove is at least approximately parallel to the force of gravity.

2. The method in accordance with claim 1, wherein the time period of the final stage is set as a function of the desired concentration of the hard material grains at the surface of the coating of the rotor groove, the size of the hard material grains, the concentration of the hard material grains in the dispersion bath and the rate of settlement of the hard material grains within the bath.

3. The method in accordance with claim 1, wherein the coating of the rotor cup is performed in a single process step.

4. The method in accordance with claim 1, further comprising the step of circulating the bath and wherein the step of reducing the concentration of hard material grains in the nickel dispersion bath comprises reducing the rate of circulating of the bath.

5. The method in accordance with claim 1, further comprising the step of circulating the bath and wherein the step of reducing the concentration of hard material grains in the nickel dispersion bath comprises stopping the circulating of the bath.

6. The method in accordance with claim 1, wherein the step of reducing the concentration of hard material grains in the nickel dispersion bath comprises continuously reducing the concentration of the hard material grains in the dispersion bath.

7. The method in accordance with claim 1, wherein the step of reducing the concentration of hard material grains in the nickel dispersion bath comprises reducing the concentration of the hard material grains in the bathing area of the rotor cup to nearly zero.

8. The method in accordance with claim 1, wherein the step of moving the rotor cup through the nickel dispersion bath comprises supporting the rotor cup on a device rotating within the bathing area of the bath and, while reducing the concentration of the hard material grains in the nickel bath, reducing the speed of the rotating device.

9. The method in accordance with claim 1, further comprising adding hard material grains to the nickel dispersion bath.

10. The method in accordance with claim 1, further comprising providing a rotor cup made of heat-treated steel, and treating the interior spinning area of the rotor cup with boron prior to the coating process.

11. The method in accordance with claim 10, wherein, prior to coating with the nickel dispersion bath, an $\alpha$-iron layer is created on the surface of the rotor cup treated with boron.

* * * * *